US007752774B2

(12) United States Patent
Ussher

(10) Patent No.: US 7,752,774 B2
(45) Date of Patent: Jul. 13, 2010

(54) POWERED SHOE TIGHTENING WITH LACE CORD GUIDING SYSTEM

(75) Inventor: Timothy James Ussher, Leatherhead (GB)

(73) Assignee: Tim James Ussher, Leather Head, Surrey (GB)

( * ) Notice: Subject to any disclaimer, the term of this patent is extended or adjusted under 35 U.S.C. 154(b) by 650 days.

(21) Appl. No.: 11/810,101

(22) Filed: Jun. 5, 2007

(65) Prior Publication Data

US 2008/0301919 A1 Dec. 11, 2008

(51) Int. Cl.
*A43C 11/00* (2006.01)

(52) U.S. Cl. ..... 36/50.1; 36/100; 36/138

(58) Field of Classification Search ..... 36/50.1, 36/138, 50.5, 58.5
See application file for complete search history.

(56) References Cited

U.S. PATENT DOCUMENTS 4,741,115 A * 5/1988 Pozzobon ..... 36/117.7
5,205,055 A * 4/1993 Harrell ..... 36/50.1
6,032,387 A * 3/2000 Johnson ..... 36/50.1
6,691,433 B2 * 2/2004 Liu ..... 36/50.1
7,096,559 B2 * 8/2006 Johnson ..... 36/50.1
7,503,131 B2 * 3/2009 Nadel et al. ..... 36/50.5

* cited by examiner

*Primary Examiner*—Ted Kavanaugh

(57) ABSTRACT

The automatic shoe lace tightening system or power lace has a switch on the shoe upper to activate a small battery powered slow speed motor fixed into a recess in the heel which winds in onto the winder spool the smooth plastic or wire lacing cord passing through guiding tubes positioned across the shoe tongue and down the side of the shoe through to the motor housing upon which the tightening cord draws together the lace loop plates fixed either side of the shoe's upper adjacent to the tongue by passing in a zig-zag through cord loops fixed to and along the lace plates with the end of the cord attached to the bottom of one of the plates and the desired tension of the cord and shoe fit is automatically held in place as the cord passes through a sprung loaded clamp which can then be manually released to loosen the shoe.

1 Claim, 4 Drawing Sheets

POWERED SHOE TIGHTENING WITH LACE CORD GUIDING SYSTEM

CROSS REFERENCE TO RELATED APPLICATIONS n/a

STATEMENT REGARDING FEDERALLY SPONSORED RESEARCH OR DEVELOPMENT n/a

BACKGROUND OF THE INVENTION

Traditional tie up shoe lace cords can be difficult to manually tie effectively, consistently and quickly. This is constraining for either children who have not learnt to tie traditional laces into bows/knots or for people with physical handicaps, arthritis or disabilities. Furthermore lace bows/loops being positioned on the outside of the shoe can come undone or catch on something potentially causing the wearer to trip.

BRIEF SUMMARY OF THE INVENTION

To overcome these problems this power lace invention allows people to tighten and loosen the single lace cord running inside smooth gliding tubes woven into the upper part of the shoe's tongue and round lace plate loops on the shoe's uppers, by pressing a button on their shoe activating a small battery powered motor winder in the heel, which winds in the cord and is held at the desired tension with a clasp through which the cord runs and can be manually released, allowing for a fast and convenient method for all people to have the properties of traditional lace fitted shoes without having to tie a bow/knot.

DETAILED DESCRIPTION OF THE INVENTION

Figure 1:
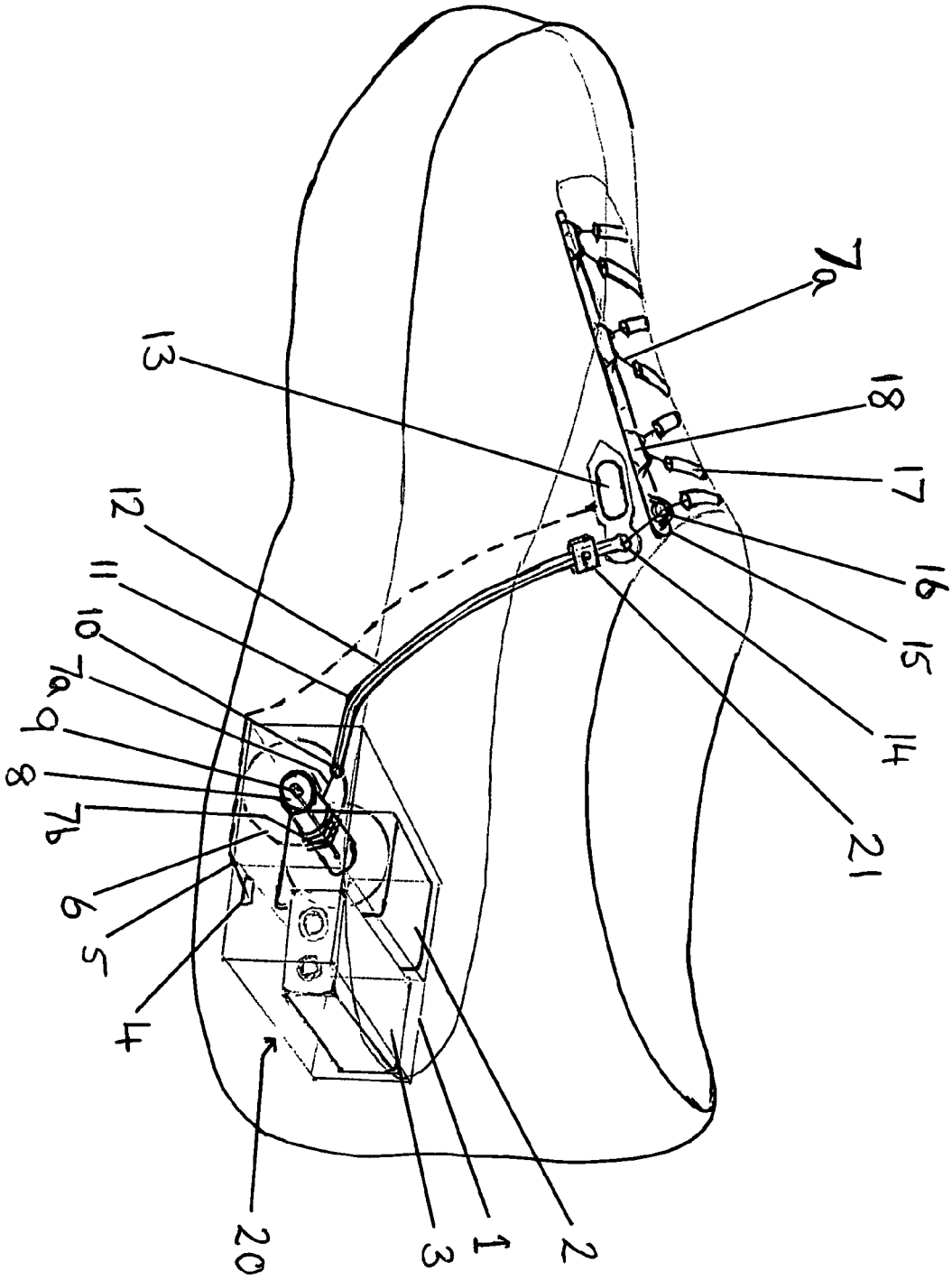
FIG. 1 shows the view of a left shoe from the outer side with the lace cord running through its guiding tubes which are woven into the upper part/sides and tongue of the shoe through the holding clamp and down to the battery powered motor winder in the heel, with the motors 'do up' activation button and cord holding clip on the top of the shoe.
Figure 2:
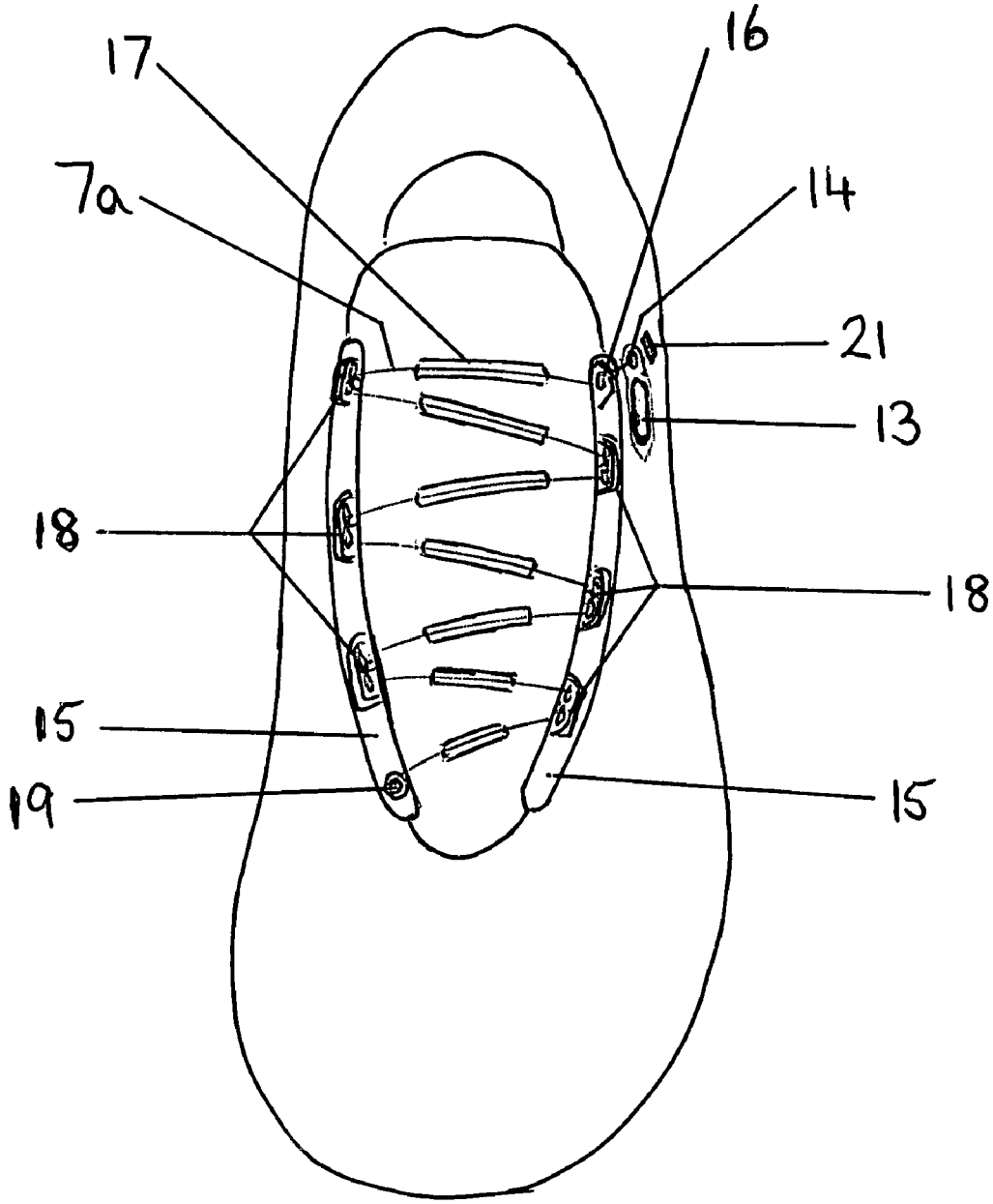
FIG. 2 shows the view of a left shoe from above with the lace cord running through the ringlet loop plates on each side of the upper next to the tongue and the guiding tubes woven into the tongue top and the cord end fixed near the base of one of the lace plates.
Figure 3:
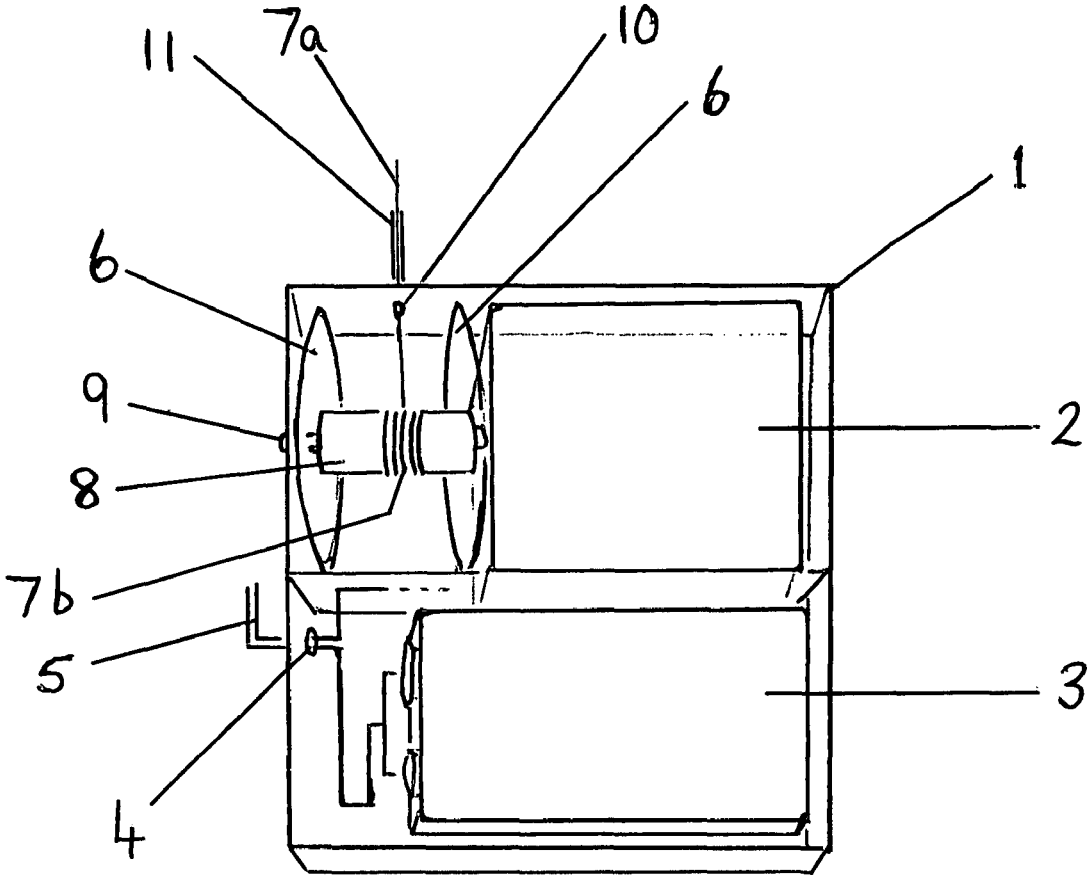
FIG. 3 shows the motor and battery housing box in the heel from above with the cord winder spool and spool guards.
Figure 4:
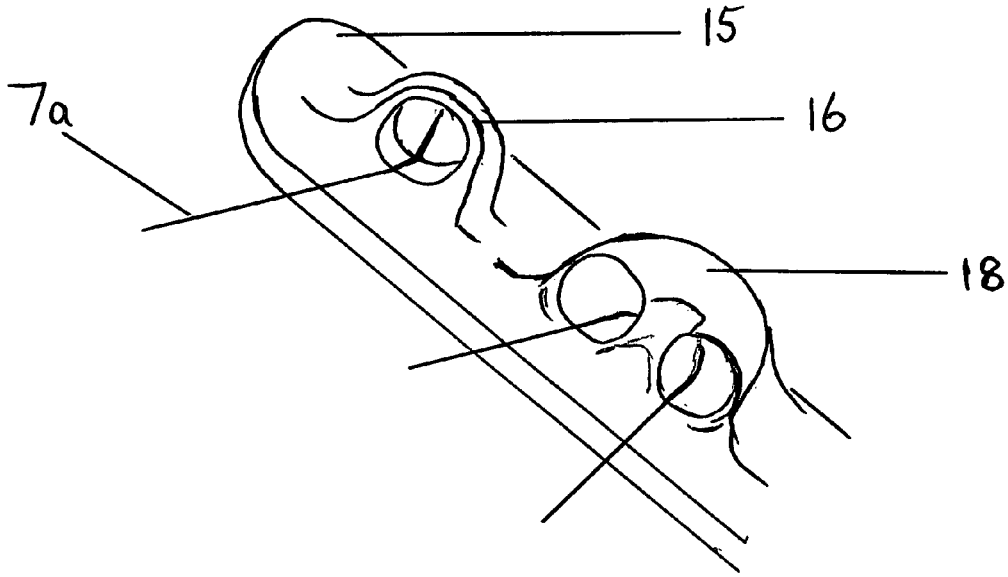
FIG. 4 shows the top end of a lace loop plate which is attached to the uppers each side of the tongue, with the first eyelet hole for the cord to pass through and one of the subsequent loop tubes guiding the cord's turn across the shoe.
Figure 5:
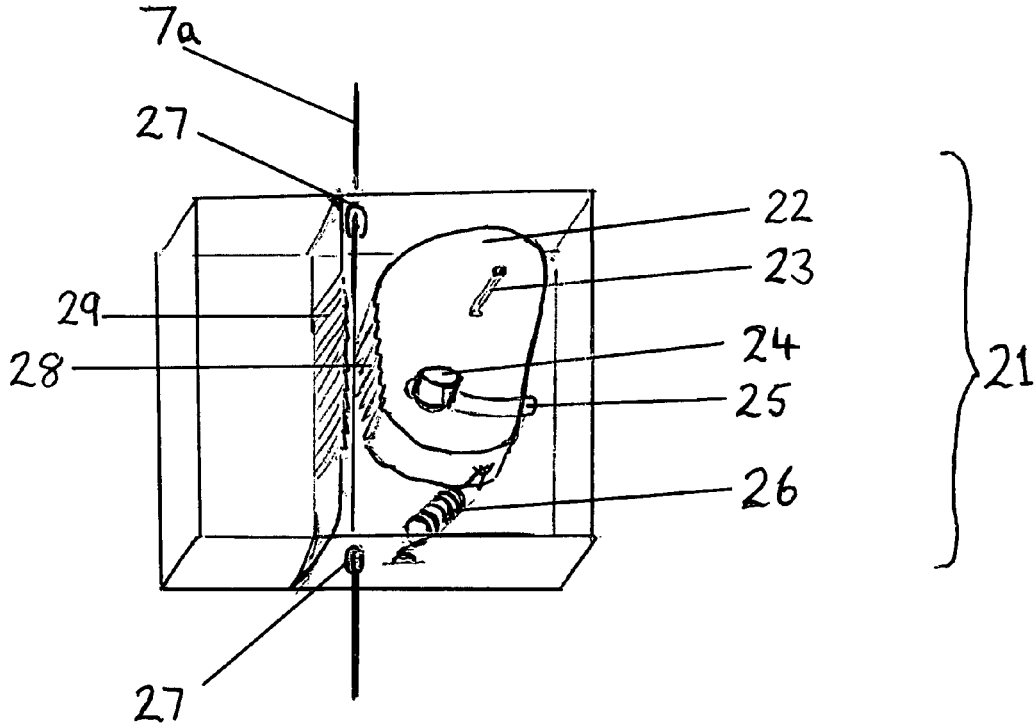
FIG. 5 shows the lace cord holding clip through which the cord passes freely when being tightened (cord moving downwards) and is held from loosening (cord moving upwards) by the sprung loaded grip edged clasp which is manually releasable.

An example of the power lace invention will now be described by referring to the accompanying drawings;

The single housing case 1 for both the motor 2 and the battery 3 is fixed within a recess in the shoe's heel and covered with a detachable plate or lid 20 likely to be in the style of the rest of the shoe's sole and removable for access to the motor 2 and battery 3. The motor 2 and battery 3 are held firmly in place with their fit into the housing box 1 so as not to dislodge when the shoe is in use.

The wires 5 connect the battery 3 to the activation button or switch 13 and back to the motor and enter and exit the housing 1 via a hole 4. The wires 5 travel up the outer side of the shoe and are concealed in between the outer upper and inner lining.

The small motor 2 has a slow speed of approx 15-20 revolutions per minute with instant consistent torque (pull strength) and will turn in one direction when activated. The lace cord is attached 7*b* to a small winding spool 8 on the motors rotary spindle, round which the cord 7*b* wraps when the motor and therefore is activated and the cord wound in.

At both sides of the winding spool 8 are circular cord guides or guards 6 fixed to the spool with a circumference almost as large as the housing 1 will allow so as to ensure the cord 7*b* is wound onto the spool 7 without cause to slip onto the inner spindle of the motor and spool and clog the operation.

The end of the motors spindle is secured with it protruding through a fixing hole 9 in the side of the housing 1.

The battery 3 or batteries will be of an appropriate size, voltage and power to compliment the motor's 2 activation and power input requirements for it to perform its role.

The 'lace cord' 7*a* is made of strong smooth plastic such as nylon monofilament or braided line or possibly wire and is of a material so as to minimise its friction against its guiding tubes and loops and may benefit from light lubrication to assist this.

The cord is attached 7*b* to the motors winding spool 8 entering the battery/motor housing case 1 through a hole 10 aligned to ensure the cord stays fed centrally onto and off the winder spool 8. The cord 7*a* then passes through the heel and up the outer side of the shoe guided round the wearers foot within a plastic guiding tube 11 woven into the shoe's lining/upper 12.

The cord 7*a* passes through the holding clamp 21 and up through the first eyelet 16 which is fixed on top of the lace loop plate 15 sited on the outer edge of the upper adjacent to the tongue. The lace plate 15 runs down each side of the uppers edge adjacent to the tongue in place of the traditional lace holes.

The cord 7*a* then passes through the first tongue guide tube 17 attached to the top of the shoe's tongue, guiding the cord over and across the tongue. The tongue tube is of a lesser width than the tongue and must allow for the shoe's uppers being drawn closer together as the shoe tightens so as not to pass over of hinder the cord passing cleanly through the ends of the tongue guiding tubes 17.

The cord 7*a* then passes through each of the hard plastic tube loops 18 which are fixed to or part of the lace loop plates 15 assisting the 'turning' of the lace cord direction so that the cord proceeds down the shoe in a zig-zag format thus redirecting it back towards the other side through the next tongue tube 17. The end of the cord 7*a* is finally attached 19 to the bottom of one of the lace plates 15.

By pressing the 'do up' button or switch 13 on top of the shoe, the motor 2 is activated winding in the cord 7*a* onto 7*b* the winding spool 8 which is pulled through its guiding tubes on the shoe's side 11, through the fixing clamp 21, through the first eyelet 16, and through the succession of tongue tubes 17 and loop 18 on the two lace plate 15. The tightening of this cord 7*a* draws together the two lace plates 15 running down each side of the shoe's upper thus closing and tightening the shoe's fit on the wearer.

The cord 7*a* passes through the fixing clamp 21 where the via entry and exit guide holes 27 and runs past a fixed serrated edge 29. On the other side of the cord is a sprung loaded clasp 22 which also has a serrated edge 28 running next to the passing cord 7*a*. The clasp 22 is drawn towards and against the cord and the fixed serrated edge 29 by a small spring 26 attached to the clasp 22 and the inside of the clamp's case 21. The serrated edges or small teeth are pointing downwards in the direction of the cords passage when being tightened so that the cord will pass through the two serrated edges 28 and 29 freely at any time. Once the lace cord reaches the desired tension and fit of the shoe for the wearer the motor 2 activation switch 13 is released and the cord's position is held firmly in place by the clamp 21, which is positioned on the top outside upper of the shoe. The clasp 22 inside the clamp 21 casing is fixed with a small pin which passes through said clasp and above and below the clamp's 21 case allowing it to move its serrated edge 28 towards and slightly away from the other fixed serrated edge 29. To release the cord tension the wearer moves the clasp 22 away from its clamping position by pushing the release knob 24 along its guide hole 25 thus parting the two serrated edges 28 and 29 inside and allowing the cord to pass freely through the clamp 21.

The invention claimed is:

1. A powered shoe lace tightening system comprising:

a shoe upper having a foot opening, a shoe sole having a heel portion, a tongue, a battery powered motor in the shoe heel including a spool to which one end of the lace cord is attached, a switch button on the upper or tongue, a fine smooth lace cord, a plurality of tongue guide loops mounted across the tongue, two lace plates mounted on the shoe upper and bordering the foot opening, a plurality of through cord loops mounted on the lace plates, a lace cord guiding tube from the motor and spool housing and feeding the lace cord out of the upper, wherein the fine cord is wound and tightened onto the spool upon being activated by the switch button, wherein the fine lace cord is guided across and through the cord loops and through the tongue guiding tubes, wherein the other end of the fine lace cord is attached to the lowest part of one of said lace plates, thereby drawing and closing the foot opening of the upper to close and tighten the shoe, wherein said fine lace cord also passes through a one-way serrated spring loaded clasp so as to automatically hold said lace cord at the desired tension until being manually released.

* * * * *